United States Patent [19]

Dearing et al.

[11] Patent Number: 4,712,343

[45] Date of Patent: Dec. 15, 1987

[54] INTERIOR AIR VENT SHIELD

[76] Inventors: J. C. Dearing, 736 Fiesslers La., Nashville, Tenn. 37210; Donald R. Rich, 2817 Desplane Dr., Nashville, Tenn. 37217

[21] Appl. No.: 867,146

[22] Filed: May 27, 1986

[51] Int. Cl.[4] ..... E04F 15/024

[52] U.S. Cl. ..... 52/221; 52/DIG. 12; 98/1

[58] Field of Search ..... 49/463; 52/221, DIG. 12; 98/1, 101, 102, 103, 114, 119

[56] References Cited

U.S. PATENT DOCUMENTS

| | | | |
|---|---|---|---|
| 2,297,179 | 9/1942 | Walker | 52/221 |
| 3,491,486 | 1/1970 | Caruth | 49/463 |
| 3,603,048 | 9/1971 | Hadfield et al. | 52/221 |
| 4,151,894 | 5/1979 | Edwards | 49/463 X |
| 4,232,493 | 11/1980 | Gray et al. | 52/221 |

FOREIGN PATENT DOCUMENTS

| | | | |
|---|---|---|---|
| 654790 | 3/1979 | U.S.S.R. | 52/DIG. 12 |

*Primary Examiner*—Harold Joyce

*Attorney, Agent, or Firm*—Patterson, Mark J.

[57] ABSTRACT

An inexpensive and re-usable shield for temporarily covering and protecting interior vent openings in residential and commercial HVAC systems. The rectangular plate is attached to or formed with a smaller rectangular block which are each sized and grooved to allow the shield to be universally used in all standard size floor and baseboard vent openings.

1 Claim, 4 Drawing Figures

INTERIOR AIR VENT SHIELD

BACKGROUND OF THE INVENTION

The present Invention relates to a cover or shield for standard size interior air vent openings used in residential and commercial heating and air conditioning (HVAC) systems.

It is the standard practice in the construction industry to install HVAC systems, including duct work and air vent openings, prior to completion of certain interior work, such as installation of flooring, carpeting, and baseboard trim. For this reason, installation of the grills or other permanent means of covering the interior air vents is not done until the building is essentially complete and ready for occupancy. Thus, the air vent openings connected to the duct work are left open during the final construction of the structure. As a result, there has long been a problem with scrap construction material and other debris falling into uncovered floor and baseboard vent openings. This often requires extra work to remove the debris from the duct work after the structure is finally completed.

The uncovered floor vents also pose a hazard to persons working near them. This hazard of injury is particularly high when the vents are covered by workers with scrap pieces of carpeting or wood, which is sometimes done. These can give way when stepped on due to insufficient strength or not being specifically sized to perform this function.

Existing covers for openings in ventilation systems, such as those shown in U.S. Pat. Nos. 2,229,388 and 3,858,355 are intended for permanent use after the building is completed and are not suited for temporary use during the construction phase.

Therefore, what is needed is an easily removable, reusable, inexpensive and safe means for shielding interior floor and base board vents in HVAC systems during construction of the building.

SUMMARY OF THE INVENTION

The present invention relates to a re-usable, temporary and inexpensive shield or cover for standard size interior floor and baseboard air vent openings in residential and commercial HVAC systems.

It is a primary object of the invention to protect air vent openings from debris generated during interior construction of a building after the duct work is installed.

It is a further object of the invention to protect persons working in the interior of a building from injury caused by stepping into uncovered or inadequately covered air vent openings.

Another object of the invention is to allow an air vent shield of one size to be used in any standard floor vent opening or, by a simple breaking or cutting operation, be adaptable for use in covering a standard size baseboard vent opening.

DESCRIPTION OF THE PREFERRED EMBODIMENT

Figure 4:
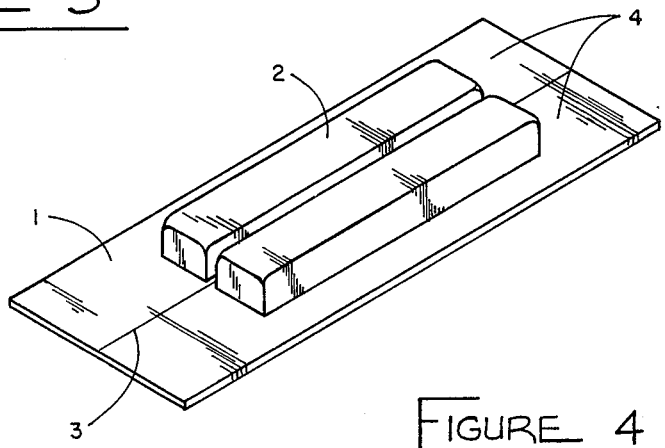
FIG. 4 is a bottom perspective view of the shield apparatus.

FIG. 4 shows a bottom perspective view of the shield, comprising plate 1, block 2, and groove 3. Plate 1 is made of plastic or other similar inexpensive, durable material. A rectangular block 2, made of the same material, is attached to or formed with the bottom planar surface of plate 1. The dimensions, of plate 1 are slightly greater than those of a large standard size floor vent opening, which are typically 4"×10" or 4"×12", and also slightly greater than a standard size baseboard vent opening, which is typically 2¼"×12". The thickness of plate 1 is selected, depending on the strength of the material used, such that in conjunction with block 2, the shield can support incidental weight applied by workers who might step on the shield while working.

Block 2 is centrally located on the bottom planar surface of plate 1, with its outer edges aligned and parallel with the corresponding outer edges of plate 1. The length and width of block 2 are slightly less than the dimensions of a small size floor vent opening, typically 4"×10", thus allowing the shield to remain relatively stationary when placed in a vent opening. The dimensions of plate 1 are selected such that maximum movement of block 2 while in the vent opening will still permit plate 1 to fully cover a larger standard (4"×12") vent opening 5.

Groove 3 is etched, cut, or molded into, and centered on, the bottom planar surfaces of plate 1 and block 2. The depth of groove 3 is selected, depending on the material used for plate 1 and block 2, to facilitate the breaking or cutting of the shield along groove 3 by the installer. The width of plate 1 is such that when the shield is broken or cut along groove 3, remaining segments 4 are each large enough to cover a standard baseboard vent, typically 2¼"×12".

Figure 2:
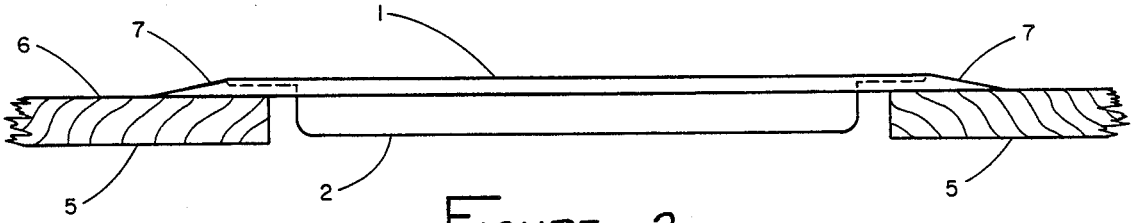
FIG. 2 is a side view of the shield apparatus, after placement in a typical 4"×10" floor vent opening.

FIG. 2 shows the shield installed in a large standard floor vent opening 5, with block 2 actually inside the floor vent opening 5 and plate 1 resting on floor surface 6.

Figure 1:
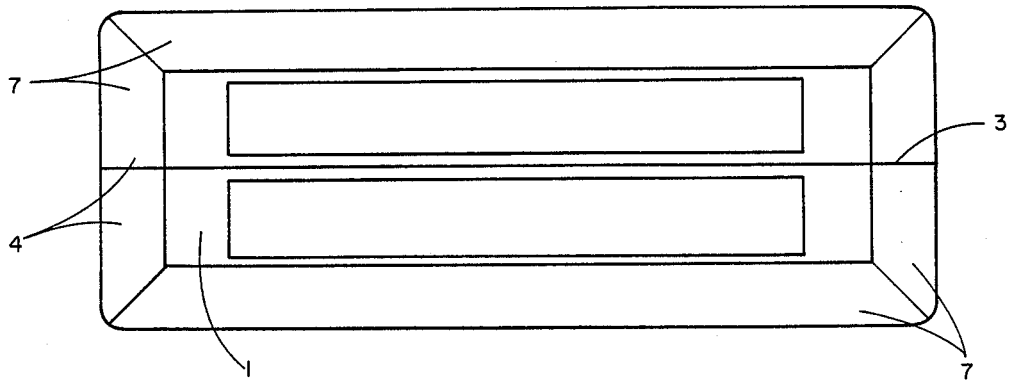
FIG. 1 is a top view of the shield apparatus, as would be seen from above if the shield were installed in a floor vent opening.
Figure 3:
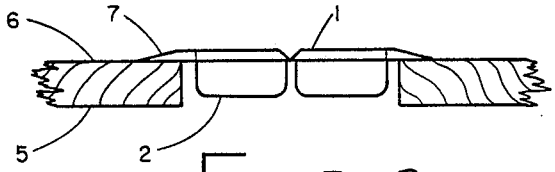
FIG. 3 is an end view of the shield apparatus.

Although not necessary to the function and purpose of this shield apparatus, FIGS. 1, 2, and 3 show a downward tapering of and toward the outer perimeter surfaces 7 of plate 1 to minimize the risk of the shield being dislodged by kicking or other incidental contact.

What is claimed, is:

1. A shield for covering interior air vent openings during construction of residential or commerical buildings comprising:

a. a rectangular floor plate sized to cover the largest of standard floor vent openings, the width of said plate being slightly greater than twice the width of a standard baseboard vent opening;

b. a rectangular block attached to or formed with said plate along their respective largest planar surfaces, generally centrally located on and parallel aligned with said plate but having smaller outside dimensions which are slightly smaller than the smallest standard floor vent opening; and c. a groove for facilitating cutting or breaking of said shield, said groove linearly and centrally located along the lower planar surfaces of said plate and block, said groove extending partially into said plate and block, and aligned and parallel with the longest outside edges of said plate and block.

* * * * *